US008225939B2

(12) United States Patent
Nelson et al.

(10) Patent No.: US 8,225,939 B2
(45) Date of Patent: Jul. 24, 2012

(54) APPEARANCE INSPECTION APPARATUS

(75) Inventors: Raymond Nelson, Crystal Lake, IL (US); Osamu Suzuki, Elk Grove Village, IL (US)

(73) Assignee: Daiichi Jitsugyo Viswill Co., Ltd., Suita-shi, Osaka (JP)

( * ) Notice: Subject to any disclaimer, the term of this patent is extended or adjusted under 35 U.S.C. 154(b) by 170 days.

(21) Appl. No.: 12/715,060

(22) Filed: Mar. 1, 2010

(65) Prior Publication Data

US 2011/0209968 A1 Sep. 1, 2011

(51) Int. Cl.
*B07C 5/02* (2006.01)

(52) U.S. Cl. ..... 209/538; 209/315; 209/552; 209/577; 209/938

(58) Field of Classification Search ..... 209/552, 209/654, 655, 660, 682, 910, 911, 920, 938
See application file for complete search history.

(56) References Cited

U.S. PATENT DOCUMENTS 4,003,831 A * 1/1977 Tishkov et al. ..... 209/315
5,444,749 A * 8/1995 Nambu ..... 377/6
5,695,043 A * 12/1997 Maezuru et al. ..... 198/689.1
5,878,868 A * 3/1999 Gotoh et al. ..... 198/689.1
2003/0127372 A1* 7/2003 Kenneway ..... 209/538
2008/0217217 A1* 9/2008 Toms ..... 209/579
2009/0107896 A1* 4/2009 Gochar, Jr. ..... 209/577
2011/0209968 A1* 9/2011 Nelson et al. ..... 198/376

FOREIGN PATENT DOCUMENTS

JP 61-211209 A 9/1986

* cited by examiner

*Primary Examiner* — Terrell Matthews
(74) *Attorney, Agent, or Firm* — Smith Patent Office

(57) ABSTRACT

An appearance inspection apparatus 1 has an aligning and conveying device 25 which has an aligning and conveying member 26 with one or a plurality of conveying passages, and a vibration exciter for alignment 37 for applying a vibration to the aligning and conveying member 26 and which aligns the inspection objects in a row and conveys them in each of the conveying passages, a slide-down mechanism 40 which has slide-down passages separately connected to the respective conveying passages of the aligning and conveying member 26 an provided to be tilted downward with respect to extensions of the slide-down passages, an imaging device 60 disposed in the vicinity of the slide-down passages for imaging the inspection objects sliding down in the slide-down passages, and a sorting device 80 for analyzing the images of the inspection objects captured by the imaging device, judge the qualities thereof, and sorting the inspection objects sliding down in the slide-down passages on the basis of analysis results.

13 Claims, 7 Drawing Sheets

APPEARANCE INSPECTION APPARATUS

TECHNICAL FIELD

The present invention relates to an apparatus for inspecting the appearance of medicine (tablets, capsules etc.), foods, machine parts, electronic parts etc. (hereafter referred to as an "inspection object").

BACKGROUND ART

As the above-described appearance inspection apparatus, for example, an apparatus disclosed in the Japanese Unexamined Patent Application Publication No. 61-211209 is known conventionally.

This inspection apparatus has a hopper for receiving a large number of inspection objects, a vibratory feeder for linearly conveying the inspection objects discharged from the lower end of the hopper, a flow straightening mechanism for aligning the inspection objects conveyed by the vibratory feeder in a row and discharging them, a first conveying device for conveying the inspection objects discharged from the flow straightening mechanism while supporting the lower surfaces thereof, a second conveying device for conveying the inspection objects conveyed by the first conveying device while sucking the upper surfaces thereof, a third conveying device for conveying the inspection objects conveyed by the second conveyed device while sucking the lower surfaces thereof, a first imaging device for imaging the lower surfaces of the inspection objects being conveyed by the second conveying device, and a second imaging device for imaging the upper surfaces of the inspection objects being conveyed by the third conveying device, and a sorting device for analyzing both of the images of the upper and lower surfaces of each inspection object which are captured by the first imaging device and the second imaging device, judging the qualities of the upper and lower surfaces, and sorting the inspection objects according to the judgment results.

According to this inspection apparatus, first of all, a large number of inspection objects are thrown into the hopper. Then, by the vibration of the vibratory feeder, the inspection objects thrown in are discharged in turn from the lower end of the hopper and conveyed to the flow straightening mechanism. Thereafter, the inspection objects are aligned in a row by the flow straightening mechanism, and are discharged and passed to the first conveying device in such a state. A conveying speed of the first conveying device is set higher than a discharge speed of the flow straightening mechanism, and therefore, in the first conveying device, the inspection objects are conveyed in a state of being separated from each other at a predetermined interval depending on the difference between the speeds.

Thereafter, the inspection objects are conveyed with the upper surfaces thereof sucked and held by the second conveying device and the lower surfaces thereof are imaged by the first imaging device during the conveyance, and then they are conveyed with the lower surfaces thereof sucked and held by the third conveying device and the upper surfaces thereof are imaged by the second imaging device during the conveyance. The qualities of the upper and lower surfaces of each of them are judged by the sorting device from both of the captured images of the upper and lower surfaces, and the inspection objects conveyed by the third conveying device are sorted according to the judgment results.

Thus, according to the appearance inspection apparatus of the conventional example, it is possible to automatically inspect both of the upper and lower surfaces of each inspection object, and it is possible to automatically sorting the inspection objects into good products and defective products.

SUMMARY OF INVENTION

Technical Problem

However, in the above-described conventional appearance inspection apparatus, in order to convey and image inspection objects in a state where they are separated from each other, the apparatus has a first conveying device, a second conveying device and a third conveying device. They each need a belt for conveyance and a power therefor, and especially, the second and third conveying devices each have a complicated configuration and need a vacuum pump for suction, which leads to a high manufacturing cost.

The above conveying devices each have an advantage of being able to convey inspection objects in a stable position, however, on the other hand, as described above, have a disadvantage of leading to a high cost.

In the field of the appearance inspection, naturally there is an inspection object requiring an inspection with high accuracy. However, on the other hand there is also an inspection object for which inspection with comparatively low accuracy can be employed. In this case, there is a need for an inexpensive apparatus.

The present invention has been achieved in view of the above-described circumstances and an object of the present invention is to provide an appearance inspection apparatus which has a simpler structure compared with conventional apparatuses, thereby suppressing the manufacturing cost thereof.

Solution to Problem

The present invention, for achieving the above-described object, relates to an appearance inspection apparatus comprising:

an aligning and conveying device having an aligning and conveying member with one or a plurality of conveying passages, and a vibration exciter for alignment for applying a vibration to the aligning and conveying member, the aligning and conveying device for advancing inspection objects placed on the aligning and conveying member in the conveying passages by applying a vibration to them, and for, in each of the conveying passages, aligning the inspection objects in a row and conveying them;

a slide-down mechanism having slide-down passages which are separately connected to the respective conveying passages of the aligning and conveying member for allowing the inspection objects to freely slide down therein, and which are provided being tilted downward with respect to extensions of the conveying passages;

an imaging device disposed in the vicinity of the slide-down passages for imaging upper surfaces of the inspection objects sliding down in the slide-down passages; and a sorting device for analyzing the images of the inspection objects which are captured by the imaging device, judging the qualities of the upper surfaces of the inspection objects, and sorting the inspection objects sliding down in the slide-down passages on the basis of the judgment results.

According to this appearance inspection apparatus, first of all, inspection objects are conveyed by the aligning and conveying device toward the slide-down mechanism in a state of being aligned in a row in each of the conveying passages. Thereafter, the inspection objects in turn successively enter the corresponding slide-down passages of the slide-down mechanism and freely slide downward in the slide-down passages. During the sliding in the slide-down passages, the upper surfaces of the inspection objects are imaged by the imaging device. By the sorting device, the qualities of the upper surfaces of the inspection objects are judged on the basis of the captured images and the inspection objects sliding down in the slide-down passages are sorted on the basis of the judgment results.

As described above, in the present invention, the slide-down passages are provided being tilted downward with respect to the extensions of the conveying passages. Thereby, the inspection objects which in turn enter the slide-down passages slide down while their speed is increased by the gravitational acceleration, and slide down in a state of being sufficiently separated from each other while intervals between the inspection objects sliding down are gradually increased. Therefore, the imaging device can surely image one inspection object and the sorting device can accurately judge the qualities of the inspection objects.

Thus, in the appearance inspection apparatus of the present invention, since the apparatus has a configuration where a slide-down mechanism having slide-down passages tilted downward with respect to extensions of conveying passages is provided in order to convey inspection objects and image them in a state where the inspection objects are separated from each other, the structure thereof is extremely simple and compact. Therefore, it is possible to make the manufacturing cost thereof much lower compared with a conventional appearance apparatus having a belt, a power for driving the belt, a vacuum pump etc. Further, the installation area for the apparatus can be small, and in this sense also it is possible to reduce the cost required for inspection.

It is preferred that the slide-down mechanism has an angle adjustment part for adjusting a tilt angle of the slide-down passages. Because friction resistance between the inspection object and the bottom of the slide-down passage commonly differs depending on the material etc. of the inspection object, the slide-down speed differs depending on the inspection object when the tilt angle is the same for all. When sliding down at a too high speed, the inspection objects cannot be accurately imaged, and, in contrast, when sliding down at a too low speed, the inspection objects cannot be separated at sufficient intervals. In both cases, accurate inspection cannot be performed. Accurate inspection can be achieved by adjusting the tilt angle by means of the angle adjustment part in order to obtain an optimum slide-down speed depending on the inspection object. It is noted that, when the tilt angle of the slide-down passages with respect to a horizontal plane is adjusted so as to be within a range of 20° to 30°, it is possible to obtain an optimum slide-down speed with reference to the inspection object of most materials. Therefore, it is preferred that the angle adjustment part can adjust the tilt angle within this range. Further, when the imaging device is attached to the slide-down mechanism, change of the focal point of the imaging device on the inspection object is not occurred at the time of the adjustment of the tilt angle of the slide-down passages by means of the angle adjustment part, and this is preferable.

Furthermore, it is preferred that the imaging device has an illumination mechanism for illuminating the upper surfaces of the inspection objects sliding down in the slide-down passages from the front and back sides in the slide-down direction thereof. By providing such an illumination mechanism, it is possible to illuminate the entire upper surfaces of the inspection objects, and therefore, it is possible to perform an accurate inspection.

The apparatus may be configured so that:

the slide-down passages each has a bottom surface at least a part of which is configured with a transparent member;

the imaging device is configured to image the upper surfaces of the inspection objects sliding down in the slide-down passages, and to image the lower surfaces of the inspection objects through the transparent member; and the sorting device is configured to analyze both of the images of the upper and lower surfaces of the inspection objects which are captured by the imaging device, judge the qualities of the upper and lower surfaces of the inspection objects, and sort the inspection objects on the basis of the judgment results. When thus configured, it is possible to simultaneously inspect both of the upper and lower surfaces of each inspection object, and therefore, it is possible to perform an efficient inspection.

In this case, it is preferred that the imaging device has a first illumination mechanism for illuminating the upper surfaces of the inspection objects sliding down in the slide-down passages from the front and back sides in the slide-down direction thereof and a second illumination mechanism for illuminating the lower surfaces of the inspection objects from the front and back sides in the slide-down direction through the transparent member.

Further, the appearance inspection apparatus may have a vibration feeding device disposed on the upstream side in the conveying direction of the aligning and conveying device. The vibration feeding device can be configured with: a hopper for receiving a large number of inspection objects; a first supply plate, one end of which is positioned below the hopper, the other end of which is extended toward the aligning-and-conveying-member side, and in which a large number of through holes each having such a size that the inspection objects can pass therethrough are bored; a second supply plate which are provided below the first supply plate, one end of which is positioned below the part of the first supply plate where the through holes are bored, and the other end of which is connected to the aligning and conveying member; and a vibration exciter for supply for applying a vibration to the first supply plate and the second supply plate. In this case, a large number of through holes each having such a size that the inspection objects cannot pass therethrough may be bored in the second supply plate.

Advantageous Effects of Invention

As described above, with reference to the appearance inspection apparatus of the present invention, the structure thereof is extremely simple and compact as a whole compared with a conventional appearance apparatus, and therefore, the manufacturing cost thereof is low. Further, the installation area for the apparatus can be small, and therefore, it is possible to reduce the cost required for inspection.

DESCRIPTION OF EMBODIMENTS

Hereinafter, a preferred embodiment of the present invention will be described with reference to the accompanying drawings.

Figure 1:
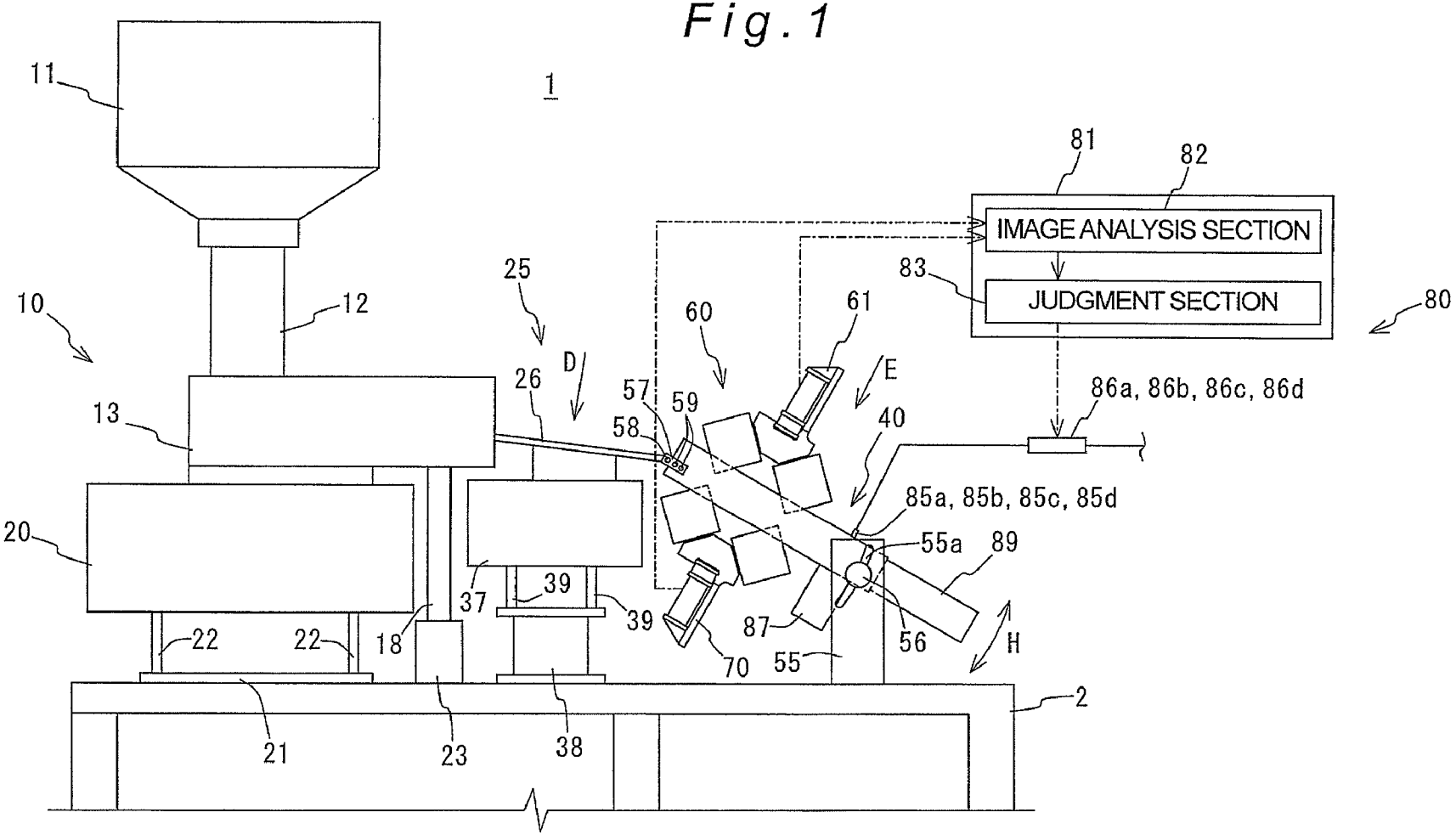
FIG. 1 is a front view showing an appearance inspection apparatus according to one embodiment of the present invention.

As shown in FIG. 1, an appearance inspection apparatus 1 of the embodiment has a foundation 2, a vibration feeding device 10, aligning and conveying device 25, slide-down mechanism 40, imaging device section 60, and sorting device section 80 which are disposed on the foundation 2. Each of the components is described in detail below.

An inspection object which can be inspected by the appearance inspection apparatus of the present invention includes medicine (tablets, capsules etc.), foods, machine parts, electronic parts etc. With reference to the embodiment, the description will be made assuming that the inspection object is a tablet formed in a circular shape in plan view.

<Vibration Feeding Device>

The vibration feeding device 10 is configured with: a vibration exciter 20 for supply disposed on the foundation 2 via an installation plate 21 and supports 22; a conveying portion 13 fixedly disposed on the vibration exciter 20; a hopper 11 provided above the left end of the conveying portion 13; and a supply pipe 12 connecting the lower end of the hopper 11 and the conveying portion 13.

Figure 2:
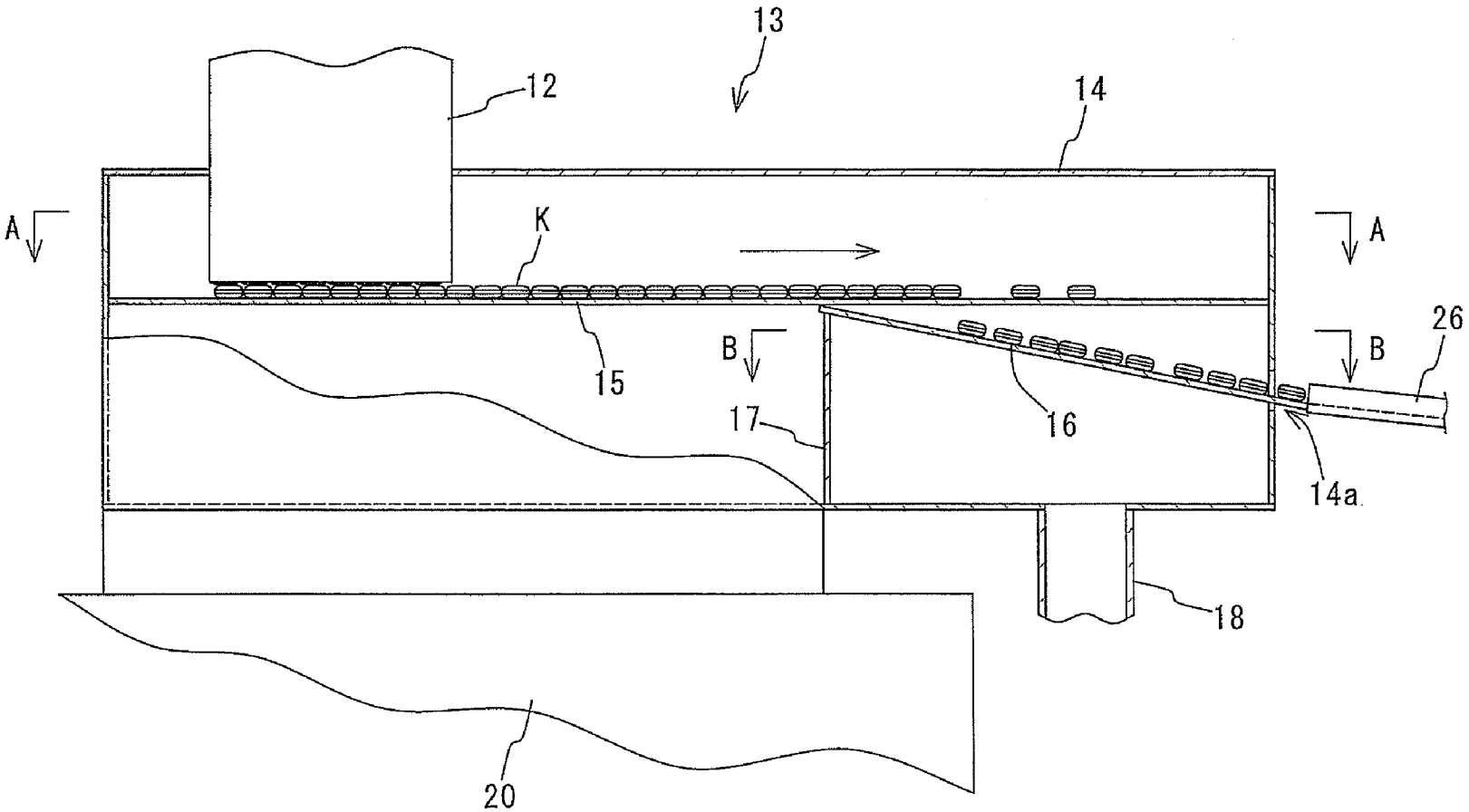
FIG. 2 is a normal sectional view showing a conveying portion according to the embodiment.

The conveying portion 13 is, as shown in FIG. 2, configured with: a case 14; a first supply plate 15 which is disposed in the case 14 in a state of being somewhat tilted downward to the right, that is, in a conveying direction (in the direction of the arrow), and which partitions the inner space of the case 14 into two upper and lower rooms; a partition plate 17 disposed upright in the lower room for partitioning the lower room into two right and left rooms; and a second supply plate 16 disposed in the lower right room in a state of being tilted downward in the conveying direction at a larger angle than the angle of the first supply plate 15.

The hopper 11 receives a large number of inspection objects K and is configured with a hollow cylindrical member having a large-diameter upper opening and a small-diameter lower opening. One end of the supply pipe 12 is connected to the lower opening. The other end of the supply pipe 12 penetrates the upper surface of the case 14 of the conveying portion 13 on the upstream side (that is, the back side) in the conveying direction, and is positioned above the first supply plate 15 and at a predetermined space (such a space that the inspection object K can pass therethrough) therefrom in the upper room.

Figure 3:
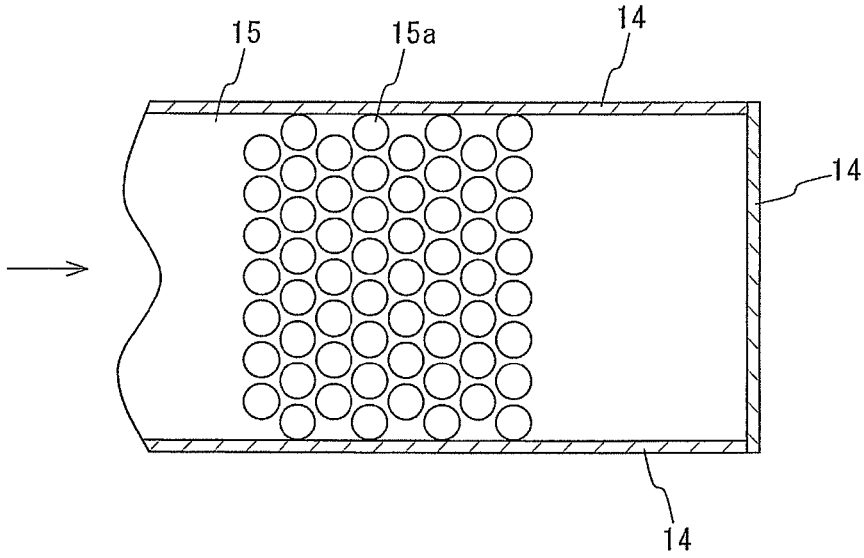
FIG. 3 is a partial sectional view taken along the arrow A-A in FIG. 2.

As shown in FIG. 3, in the first supply plate 15, on this side of the downstream end (that is, the front end) in the conveying direction (in the direction of the arrow), a large number of through holes 15*a* each having such an inner diameter that the inspection object K can pass therethrough (that is, a larger diameter than the outer diameter of the inspection object K) are bored at an almost equivalent pitch interval in a two-dimensional plane.

Figure 4:
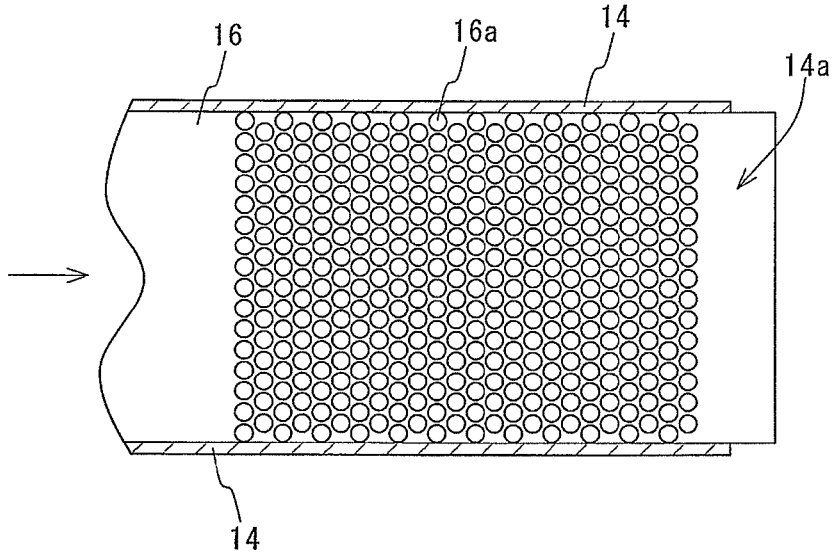
FIG. 4 is a partial sectional view taken along the arrow B-B in FIG. 2.

The second supply plate 16 is, as shown in FIGS. 2 and 4, disposed in a state of being extended outward from an opening 14*a* provided in the front end surface of the case. Further, as shown in FIG. 4, in the second supply plate 16, in an region positioned below the through holes 15*a* of the first supply plate 15, a large number of through holes 16*a* each having such an inner diameter that the inspection object K cannot pass therethrough (that is, a smaller diameter than the outer diameter of the inspection object K) are bored at the almost equivalent pith interval in a two-dimensional plane.

Further, as shown in FIGS. 1 and 2, a collecting pipe 18 connecting to a collecting box 23 is connected to the bottom face of the case 14 below the second supply plate 16.

In this vibration feeding device 10, first, a large number of inspection objects K are thrown into the hopper 11 from the upper opening of the hopper 11 and a vibration is applied to the conveying portion 13 by the vibration exciter 20.

When a vibration is applied to the conveying portion 13, as shown in FIG. 2, the inspection objects K flow out on the first supply plate 15 through the gap between the lower end of the supply pipe 12 and the first supply plate 15, and advance toward the downstream end in the conveying direction. When the inspection objects K reach the region where the through holes 15*a* are bored on this side of the downstream end, the inspection objects K in turn fall down on the second supply plate 16 positioned therebelow through the through holes 15*a*, thereafter, the inspection objects K are conveyed on the second supply plate 16 toward the opening 14*a*. At this time, if particles such as dust are deposited on the inspection objects K, the shock when falling down on the second supply plate 16 causes the deposited particles to drop down and thereby be removed. With reference to the inspection objects K broken into fragments, the fragments fall down through the through holes 16*a* when passing through the region where the through holes 16*a* are bored, thereby being removed from on the second supply plate 16.

As the result of removing the deposited particles and removing the fragments in this way, the inspection objects K each having an almost normal shape are conveyed to the conveying end of the second supply plate 16, and passed to a next aligning and supplying device 25.

The deposited particles and fragments that have fallen down through the through holes 16*a* of the second supply plate 16 are collected to the collecting box 23 through the collecting pipe 18.

<Aligning and Conveying Device>

The aligning and conveying device 25, as shown in FIG. 1, has a vibration exciter 37 for alignment disposed on the foundation 2 via an installation base 38 and supports 39, and an aligning and conveying member 26 attached to the vibration exciter 37.

Figure 5:
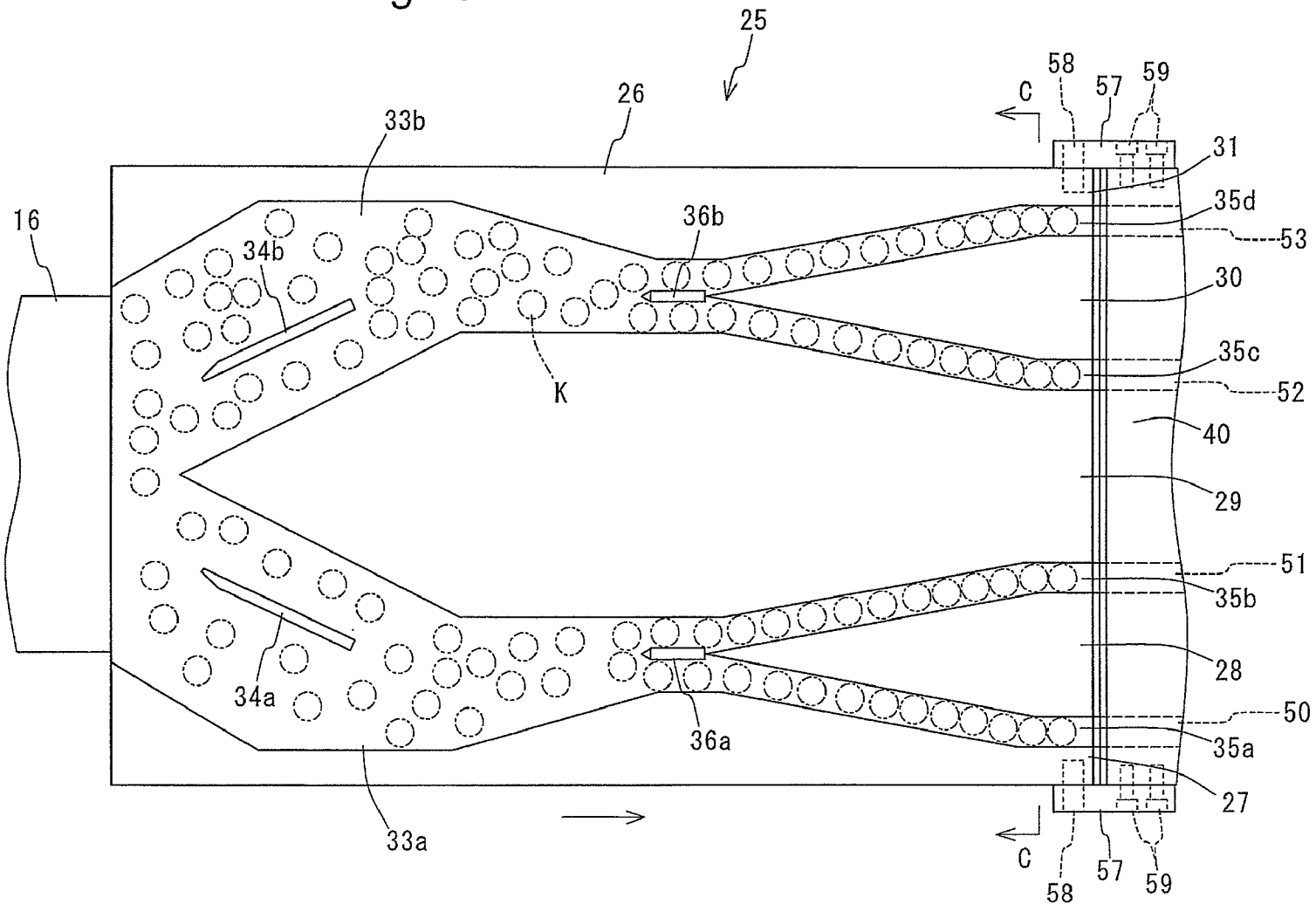
FIG. 5 is a view taken in the direction of the arrow D in FIG. 1 showing an aligning and conveying member according to the embodiment.
Figure 6:
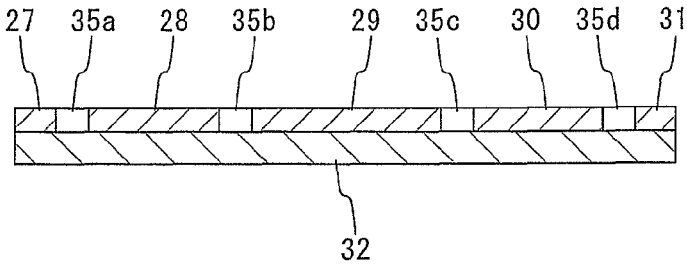
FIG. 6 is a sectional view taken along the arrow C-C in FIG. 5.

The aligning and conveying member 26 is, as shown in FIGS. 5 and 6, configured with a lower plate 32 connected to the second supply plate 16 so that its upper surface is connected to the upper surface of the second supply plate 16, and upper plates 27, 28, 29, 30, 31 fixedly provided on the lower plate 32.

Primary aligning and conveying passages 33*a*, 33*b* are formed on the upstream side in the conveying direction (in the direction of the arrow) between the upper plate 27 and the upper plate 29 and between the upper plate 29 and the upper plate 31, respectively. Secondary aligning and conveying passages 35*a*, 35*b* each connecting to the primary aligning and conveying passage 33*a* are formed on the downstream side in the conveying direction (in the direction of the arrow) between the upper plate 27 and the upper plate 28 and between the upper plate 28 and the upper plate 29, respectively. Similarly, secondary aligning and conveying passages 35*c*, 35*d* each connecting to the primary aligning and conveying passage 33*b* are formed between the upper plate 29 and the upper plate 30 and between the upper plate 30 and the upper plate 31, respectively. Further, the primary aligning and conveying passages 33*a*, 33*b* have flow dividing guides 34*a*, 34*b* disposed near the centers thereof in upstream-side regions therein, respectively, and have flow dividing guides 36*a*, 36*b* disposed in downstream-side regions therein, respectively.

Each of the secondary aligning and conveying passages 35*a*, 35*b*, 35*c*, 35*d* has a width which is set so that only one inspection object K can pass therethrough with a sufficient space, and each of the primary aligning and conveying passages 33*a*, 33*b* has a width which is set to be wider on the upstream side and become narrower toward the downstream.

In this aligning and conveying device 25, when the inspection objects K flow thereinto while a vibration is applied to the aligning and conveying member 26 by the vibration exciter 37, the inspection objects K are, first, divided into two conveying paths, the primary aligning and conveying passages 33*a*, 33*b*, and conveyed in the conveying passages. At this time, in the primary aligning and conveying passage 33*a*, the inspection objects K are preliminarily divided by the flow dividing guide 34*a* into two flow passages, and then are divided at the downstream by the flow dividing guide 36*a* into two conveying paths, the two secondary aligning and conveying passage 35*a*, 35*b*. Thereafter, the inspection objects K are conveyed in each the conveying passages in a state of being aligned in a row, and reach the conveyance end. Similarly, in the primary aligning and conveying passage 33*b*, the inspection objects K are preliminarily divided by the flow dividing guide 34*b* into two flow passages, and then are divided at the downstream by the flow dividing guide 36*b* into two conveying paths, the secondary aligning and conveying passages 35*c*, 35*d*. Thereafter, they are conveyed in each of the conveying passages in a state of being aligned in a row and reach the conveyance end.

The inspection objects K which are discharged from the vibration feeding device 10 and flow into the aligning and conveying device 25 are aligned in four lines in this way, and then are discharged from the aligning and conveying device 25.

<Slide-Down Mechanism>

Figure 8:
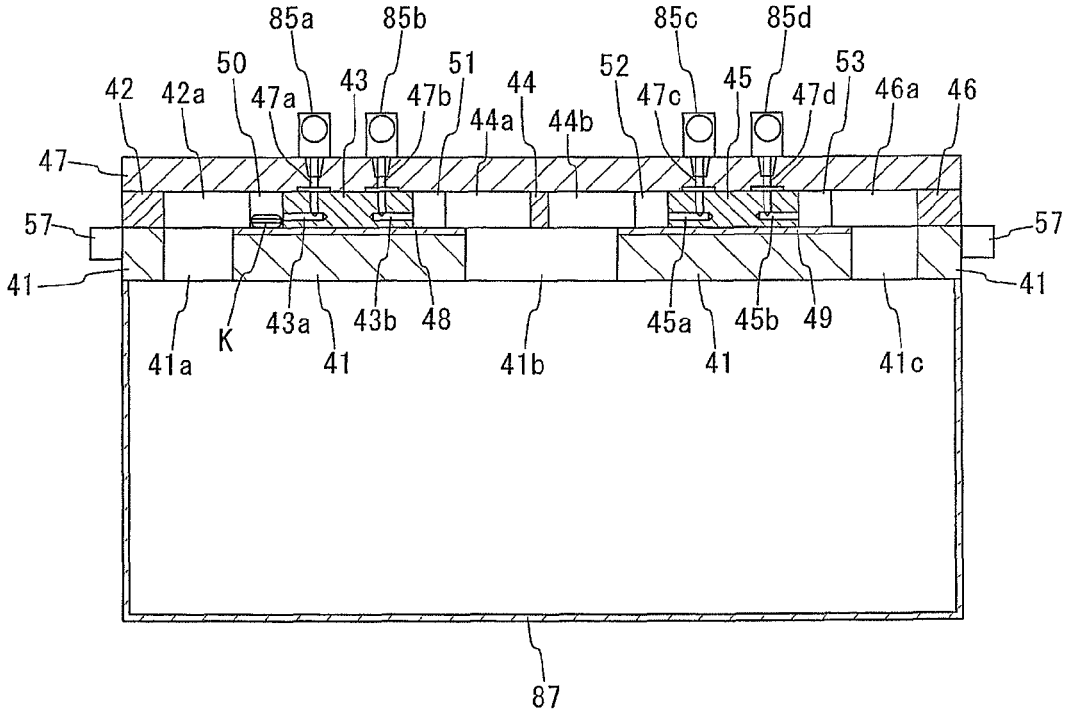
FIG. 8 is a sectional view taken along the arrow F-F in FIG. 7.
Figure 7:
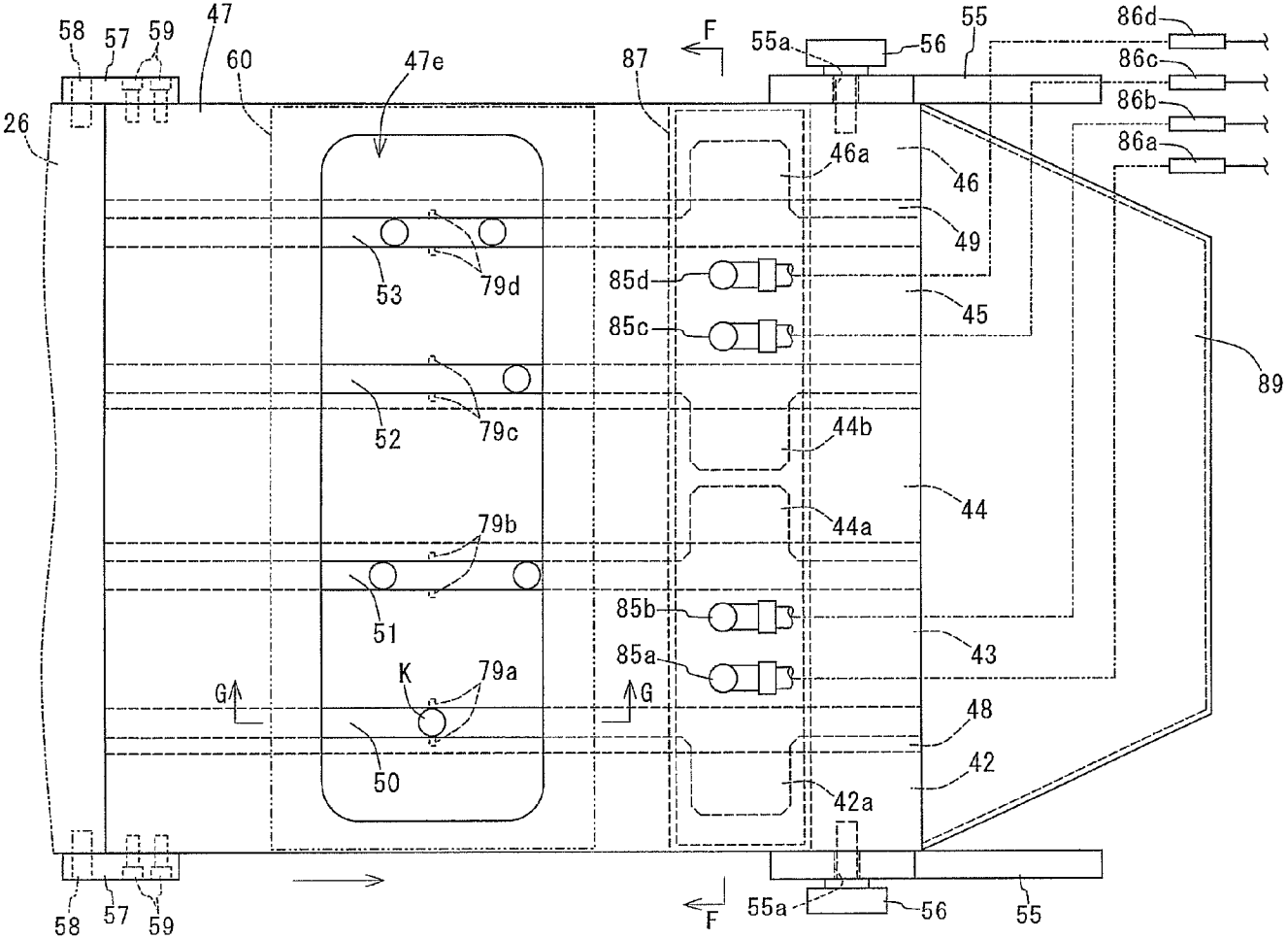
FIG. 7 is a view taken in the direction of the arrow E in FIG. 1 showing a slide-down mechanism according to the embodiment.

The slide-down mechanism 40 is, as shown in FIG. 1, is fixedly provided being tilted downward with respect to an extension of the aligning and conveying member 26. As shown in FIGS. 7 and 8, the slide-down mechanism 40 has a lower plate 41, middle plates 42, 43, 44, 45, 46 fixedly provided on the lower plate 41, and an upper plate 47 fixedly provided on the middle plates 42, 43, 44, 45, 46. A slide-down passage 50 is formed between the middle plate 42 and the middle plate 43; a slide-down passage 51 is formed between the middle plate 43 and the middle plate 44; a slide-down passage 52 is formed between the middle plate 44 and the middle plate 45; and a slide-down passage 53 is formed between the middle plate 45 and the middle plate 46.

The upper end side of the lower plate 41 is connected to the lower end of the aligning and conveying member 26 via brackets 57 which are respectively attached fixedly to both side surfaces of the lower plate 41 by bolts 59. The aligning and conveying member 26 has a support shaft 58 implanted in each of both side surfaces of the lower end thereof. The support shafts 58 are inserted into through holes bored in the brackets 57, thereby the lower plate 41 can pivot along the arrow H (in the vertical direction) as shown in FIG. 1.

On the other hand, the lower end of the lower plate 41 is fixed at both sides thereof to brackets 55 which are provided in an upstanding manner on the foundation 2. An arc-shaped long hole 55*a* with the support shaft 58 at the center is formed in each bracket 55, and the lower end of the lower plate 41 is fixed to the brackets 55 by screwing joining bolts 56 which are threaded in the side surfaces of the lower plate 41 in a state of being inserted into the long holes 55*a*.

Glass plates 48, 49 are laid on the upper surface of the lower plate 41 corresponding to the middle plate 43 and slide-down passages 50, 51 and on the upper surface of the lower plate 41 corresponding to the middle plate 45 and slide-down passages 52, 53, respectively. The slide-down passages 50, 51 each have a bottom surface formed by the glass plate 48, and similarly the slide-down passages 52, 53 each have a bottom surface formed by the glass plate 49.

The upper surfaces of the glass plates 48, 49 are connected to the upper surface of the lower plate 32 configuring the aligning and conveying member 26 at the upstream ends thereof in a slide-down direction (in the direction of the arrow). Further, the slide-down passage 50 is connected to the secondary aligning and conveying passage 35*a*; the slide-down passage 51 is connected to the secondary aligning and conveying passage 35*b*; the slide-down passage 52 is connected to the secondary aligning and conveying passage 35*c*; and the slide-down passage 53 is connected to the secondary aligning and conveying passage 35*d*. Thus, the slide-down passages 50, 51, 52, 53 are provided being tilted downward with respect to extensions of the secondary aligning and conveying passages 35*a*, 35*b*, 35*c*, 35*d*, respectively. The slide-down passages 50, 51, 52, 53 have the same width with that of the secondary aligning and conveying passages 35*a*, 35*b*, 35*c*, 35*d*.

It is noted that the brackets 55 and the joining bolts 56 function as an angle adjustment part for adjusting a tilt angle of the lower plate 41, in other words, a tilt angle of the bottom faces of the slide-down passages 50, 51, 52, 53. Due to the engagement relationship between the long holes 55*a* and the joining bolts 56 inserted therein, the lower plate 41 is pivotable within a range where an angle thereof with respect to a horizontal plane is between 20° and 30°, and therefore the tilt angle of the bottom faces of the slide-down passages 50, 51, 52, 53 is adjusted within this angle range.

The upper plate 47 has a vertically penetrating opening 47*e* formed at a position at which an imaging device section 60 specifically described later is provided, and similarly the lower plate 41 has an opening 41*d* formed therein.

Further, on this side of the downstream end in the slide-down direction, the middle plate 42 has a cut portion 42*a* formed on the slide-down passage 50 side; the middle plate 44 has cut portions 44*a* and 44*b* formed on the slide-down passage 51 side and on the slide-down passage 52 side, respectively; and the middle plate 46 has a cut portion 46*a* formed on the slide-down passage 53 side. Furthermore, the lower plate 41 has a vertically penetrating through hole 41*a* formed at a portion corresponding to the cut portion 42*a*, similarly, a through hole 41*b* at a portion corresponding to the cut portions 44*a*, 44*b*, and a through hole 41*c* at the portion corresponding to the cut portion 46*a*.

The middle plate 43 has: a flow passage 43*a* formed therein, one end of which opens in the upper surface of the middle plate 43 and the other end of which opens in the side surface of the middle plate 43 facing the cut portion 42*a*; and a flow passage 43*b* similarly formed therein, one end of which opens in the upper surface of the middle plate 43 and the other end of which opens in the side surface of the middle plate 43 facing the cut portion 44*a*. The middle plate 45 has: a flow passage 45*a* formed therein, one end of which opens in the upper surface of the middle plate 45 and the other end of which opens in the side surface of the middle plate 45 facing the cut portion 44*b*; and a flow passage 45*b* similarly formed therein, one end of which opens in the upper surface of the middle plate 45 and the other end of which opens in the side surface of the middle plate 45 facing the cut portion 46*a*.

The upper plate 47 has vertically penetrating through holes 47*a*, 47*b*, 47*c*, 47*d* bored therein, which connect to the flow passages 43*a*, 43*b*, 45*a*, 45*b*, respectively. Joints 85*a*, 85*b*, 85*c*, 85*d* connected to a compressed-air supply source (not shown) are appropriately attached to the through holes 47*a*, 47*b*, 47*c*, 47*d*, respectively.

The Joints 85*a*, 85*b*, 85*c*, 85*d* configure the sorting device section 80 specifically described later.

In this slide-down mechanism 40, the inspection objects K which are discharged from the secondary aligning and conveying passages 35*a*, 35*b*, 35*c*, 35*d* of the aligning and conveying device 25 enter the slide-down passages 50, 51, 52, 53, respectively, and they freely slide down in the slide-down passages 50, 51, 52, 53 and reach the downstream end thereof.

At this time, the inspection objects K slide down while their speed is gradually increased by the gravitational acceleration, and slide down in a state of being sufficiently separated from each other while intervals between the inspection objects K sliding down are gradually increased.

<Imaging Device Section>

Figure 9:
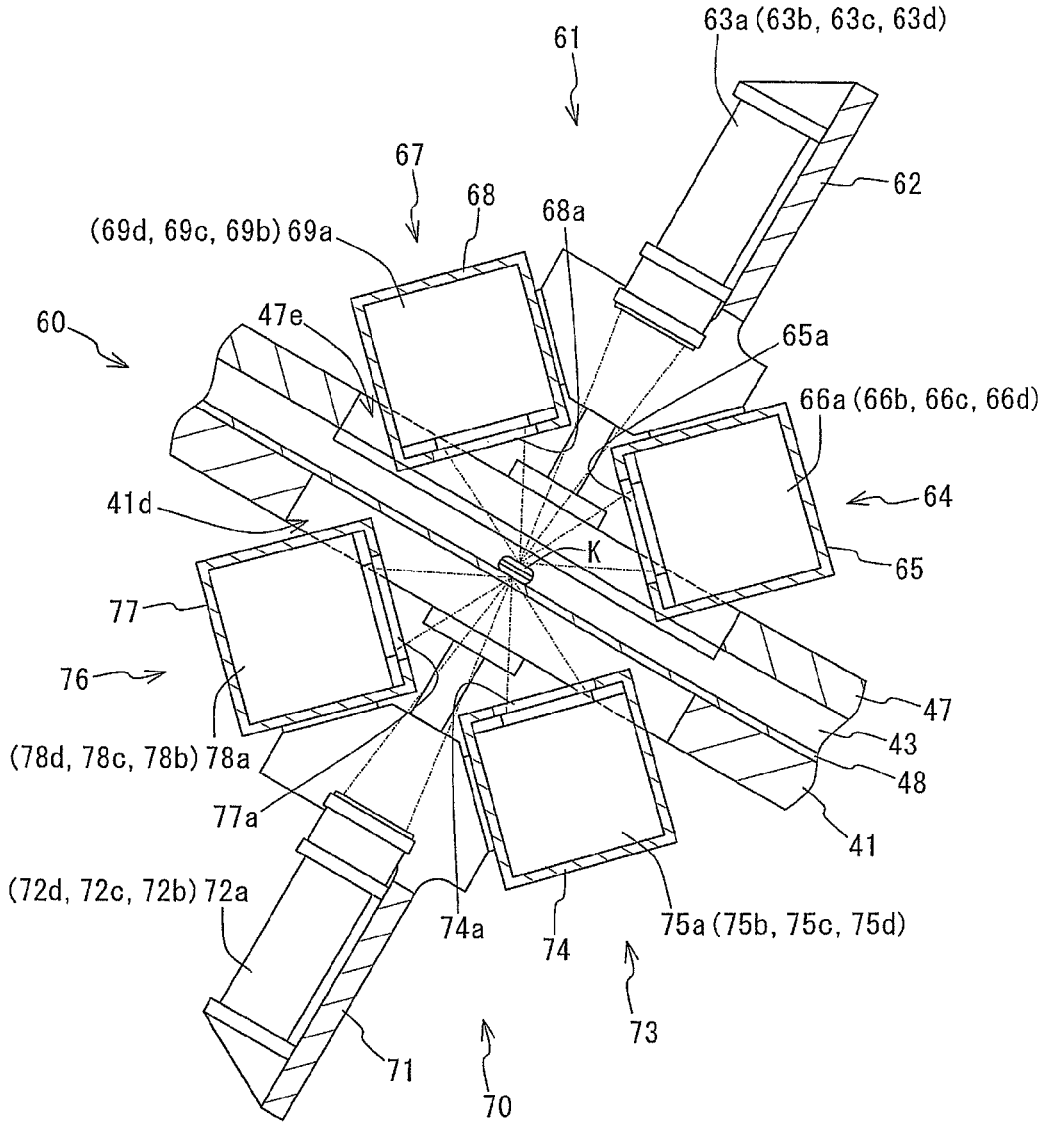
FIG. 9 is a sectional view taken along the arrow G-G in FIG. 7.

The imaging device section 60 is configured with upper and lower imaging devices 61, 70 shown in FIG. 9 and sensors 79*a*, 79*b*, 79*c*, 79*d* shown in FIG. 7.

The upper imaging device 61 is configured with: a bracket 62 fixedly provided on the upper plate 47 so as to perpendicularly intersect the slide-down direction of the slide-down passages 50, 51, 52, 53 and so as to traverse them at the opening 47*e* of the slide-down mechanism 40; four cameras 63*a*, 63*b*, 63*c*, 63*d* fixedly provided to the bracket 62; a front illuminating unit 64 attached to the bracket 62 on the front side of the cameras 63*a*, 63*b*, 63*c*, 63*d* in the slide-down direction; and a rear illuminating unit 67 attached to the bracket 62 on the back side in the slide-down direction.

The camera 63*a* is positioned above the slide-down passage 50, and is attached to the bracket 62 so that an imaging direction thereof perpendicularly intersects the bottom surface of the slide-down passage 50. Similarly, the camera 63*b* is attached to the bracket 62 above the slide-down passage 51 so that an imaging direction thereof perpendicularly intersects the bottom surface of the slide-down passage 51; the camera 63*c* is attached to the bracket 62 above the slide-down passage 52 so that an imaging direction thereof perpendicularly intersects the bottom surface of the slide-down passage 52; and the camera 63*d* is attached to the bracket 62 above the slide-down passage 53 so that an imaging direction thereof perpendicularly intersects the bottom surface of the slide-down passage 53.

The front illuminating unit 64 is configured with: a long holding box 65 fixedly provided to the bracket 62 so as to be parallel to the upper plate 47 and so as to perpendicularly intersect the slide-down direction of the slide-down passages 50, 51, 52, 53; and lamps 66*a*, 66*b*, 66*c*, 66*d* held in the holding box 65 so as to be positioned above the slide-down passages 50, 51, 52, 53, respectively. The lamps 66*a*, 66*b*, 66*c*, 66*d* are configured to illuminate imaging areas of the cameras 63*a*, 63*b*, 63*c*, 63*d* from the front side in the slide-down direction through an opening 65*a* formed on the holding box 65, respectively.

Similarly, the rear illuminating unit 67 is configured with: a long holding box 68 fixedly provided to the bracket 62 so as to be parallel to the upper plate 47 and so as to perpendicularly intersect the slide-down direction of the slide-down passages 50, 51, 52, 53; and lamps 69*a*, 69*b*, 69*c*, 69*d* held in the holding box 68 so as to be positioned above the slide-down passages 50, 51, 52, 53, respectively. The lamps 69*a*, 69*b*, 69*c*, 69*d* illuminate imaging areas of the cameras 63*a*, 63*b*, 63*c*, 63*d* from the back side in the slide-down direction through an opening 68*a* formed on the holding box 68, respectively.

The lower imaging device 70 has the same configuration as that of the upper imaging device 61, and is arranged below the slide-down passages 50, 51, 52, 53 so as to be symmetrical to the upper imaging device 61 across the slide-down passages 50, 51, 52, 53. The lower imaging device 70 has: a bracket 71 fixedly provided on the lower plate 41 so as to perpendicularly intersect the slide-down direction of the slide-down passages 50, 51, 52, 53 and so as to stride them at the opening 41*d* of the slide-down mechanism 40; four cameras 72*a*, 72*b*, 72*c*, 72*d* fixedly provided to the bracket 71; a front illuminating unit 73 attached to the bracket 71 on the front side of the cameras 72*a*, 72*b*, 72*c*, 72*d* in the slid-down direction; and a rear illuminating unit 76 attached to the bracket 71 on the back side in the slide-down direction.

The camera 72*a* is positioned below the slide-down passage 50, and is attached to the bracket 71 so that an imaging direction thereof perpendicularly intersects the bottom surface of the slide-down passage 50. Similarly, the camera 72*b* is attached to the bracket 71 below the slide-down passage 51 so that an imaging direction thereof perpendicularly intersects the bottom surface of the slide-down passage 51; the camera 72*c* is attached to the bracket 71 below the slide-down passage 52 so that an imaging direction thereof perpendicularly intersect the bottom surface of the slide-down passage 52; and the camera 72*d* is attached to the bracket 71 below the slide-down passage 53 so that an imaging direction thereof perpendicularly intersect the bottom surface of the slide-down passage 53.

The front illuminating unit 73 is configured with: a long holding box 74 fixedly provided to the bracket 71 so as to be parallel to the lower plate 41 and so as to perpendicularly intersect the slide-down direction of the slide-down passages 50, 51, 52, 53; and lamps 75*a*, 75*b*, 75*c*, 75*d* held in the holding box 74 so as to be positioned below the slide-down passages 50, 51, 52, 53, respectively. The lamps 75*a*, 75*b*, 75*c*, 75*d* illuminate imaging areas of the cameras 72*a*, 72*b*, 72*c*, 72*d* from the front side in the slide-down direction through an opening 74*a* formed on the holding box 74, respectively.

Similarly, the rear illuminating unit 76 is configured with: a long holding box 77 fixedly provided to the bracket 71 so as to be parallel to the lower plate 41 and so as to perpendicularly intersect the slide-down direction of the slide-down passages 50, 51, 52, 53; and lamps 78*a*, 78*b*, 78*c*, 78*d* held in the holding box 77 so as to be positioned below the slide-down passages 50, 51, 52, 53, respectively. The lamps 78*a*, 78*b*, 78*c*, 78*d* illuminate imaging areas of the cameras 75*a*, 75*b*, 75*c*, 75*d* from the back side in the slide-down direction through the opening 77*a* formed on the holding box 77, respectively.

The sensors 79*a*, 79*b*, 79*c*, 79*d* are each configured with a combination of a light emitting element and a light receiving element. With reference to the sensor 79*a*, one of the elements thereof is buried in the middle plate 42 and the other one in the middle plate 43 so that they have the slide-down passage 50 between them in the imaging areas of the cameras 63*a*, 72*a*, and the sensor 79*a* detects the inspection object K sliding down in the slide-down passage 50 and outputs a detection signal to the cameras 63*a*, 72*a*. The cameras 63*a*, 72*a* each receive the detection signal and capture an image of the inspection object K.

Similarly, with reference to the sensor 79*b*, one of the elements thereof is buried in the middle plate 43 and the other one in the middle plate 44 so that they have the slide-down passage 51 between them in the imaging areas of the cameras 63*b*, 72*b*, and the sensor 79*b* detects the inspection object K sliding down in the slide-down passage 51 and outputs a detection signal to the cameras 63*b*, 72*b*. The cameras 63*b*, 72*b* each receive the detection signal and capture an image of the inspection object K.

Further, with reference to the sensor 79*c*, one of the elements thereof is buried in the middle plate 44 and the other one in the middle plate 45 so that they have the slide-down passage 52 between them in the imaging areas of the cameras 63*c*, 72*c*, and the sensor 79*c* detects the inspection object K sliding down in the slide-down passage 52 and outputs a detection signal to the cameras 63*c*, 72*c*. The cameras 63*c*, 72*c* each receive the detection signal and capture on image of the inspection object K.

Furthermore, with reference to the sensor 79*d*, one of the elements thereof is buried in the middle plate 45 and the other one in the middle plate 46 so that they have the slide-down passage 53 between them in the imaging areas of the cameras 63*d*, 72*d*, and the sensor 79*d* detects inspection object K sliding down in the slide-down passage 53 and outputs a detection signal to the cameras 63*d*, 72*d*. The cameras 63*d*, 72*d* each receive the detection signal and capture an image of the inspection object K.

In this imaging device section 60, when the inspection objects K sliding down in the slide-down passages 50, 51, 52, 53 of the slide-down mechanism 40 reach the imaging areas of the cameras 63*a*, 72*a*, the cameras 63*b*, 72*b*, the cameras 63*c*, 72*c*, and the cameras 63*d*, 72*d*, respectively, they are detected by the sensors 79*a*, 79*b*, 79*c*, 79*d*, respectively, and detection signals are output to the cameras 63*a*, 72*a*, the cameras 63*b*, 72*b*, the cameras 63*c*, 72*c*, and the cameras 63*d*, 72*d*, respectively.

When receiving the detection signal, for example, the camera 63*a* images of the upper surface of the inspection object K sliding down in the slide-down passage 50, and transmits the obtained image data to an inspection processing section 81 described later. At the time of imaging by the camera 63*a*, since the upper surface of the inspection object K is illuminated by the lamps 66*a*, 69*a* from the front and back sides of the inspection object K in the slide-down direction, the entire upper surface of the inspection object K is illuminated brightly, and thereby an accurate image of the entire upper surface thereof can be obtained.

On the other hand, the camera 72*a* images the lower surface of the inspection object K sliding down in the slide-down passage 50 through the glass plate 48, and transmits the obtained image data to the inspection processing section 81. At the time of imaging by the camera 72*a* also, since the lower surface of the inspection object K is illuminated by the lamps 75*a*, 78*a* from the front and back sides of the inspection object K in the slide-down direction, the entire lower surface of the inspection object K is illuminated brightly, and thereby an accurate image of the entire lower surface thereof can be obtained.

The inspection objects K sliding down in the side-down passage 50 slide down while their speed is gradually increased by the gravitational acceleration, and they become in a state of being sufficiently separated from each other while intervals between the inspection objects K are gradually increased. Therefore, the cameras 63*a*, 72*a* can surely image one inspection object K.

In the same manner, also in the cameras 63*b*, 72*b*, the cameras 63*c*, 72*c*, and the cameras 63*d*, 72*d*, the upper and lower surfaces of the inspection objects K sliding down in the corresponding slide-down passages 51, 52, 53 are imaged and the images are transmitted to the inspection processing section 81.

Since the imaging device section 60 is attached to the slide-down mechanism 40 as described above, when the tilt angle of the bottom face of the slide-down passages 50, 51, 52, 53 is adjusted by the angle adjustment part, the imaging device section 60 also pivots with them. Therefore, the focal points of each of the cameras 63*a*, 63*b*, 63*c*, 63*d*, 72*a*, 72*b*, 72*c*, 72*d* on the inspection object K are not varied.

<Sorting Device Section>

The sorting device section 80, as shown in FIGS. 1 and 7, has the inspection processing section 81, control valves 86*a*, 86*b*, 86*c*, 86*d*, the joints 85*a*, 85*b*, 85*c*, 85*d*, a good-product collecting box 89, and a defective-product collecting box 87.

The joints 85*a*, 85*b*, 85*c*, 85*d* are, as described above, attached to the through holes 47*a*, 47*b*, 47*c*, 47*d* bored in the upper plate 47, respectively. Compressed air is supplied from a not shown compressed-air supply source to the joint 85*a* through a pipe having the control valve 86*a* therein, to the joint 85*b* through a pipe having the control valve 86*b* therein, to the joint 85*c* through a pipe having the control valve 86*c* therein, and to the joint 85*d* through a pipe having the control valve 86*d* therein. Each of the control valves 86*a*, 86*b*, 86*c*, 86*d* is a valve for opening and closing the flow passage of the corresponding pipe according to a control signal, and is closed in the normal condition and opened when receiving a control signal.

The good-product collecting box 89 is provided at the end portion in the slide-down direction of the slide-down mechanism 40, and collects the inspection objects K which have slid down in the slide-down passages 50, 51, 52, 53. The defective-product collecting box 87 is attached to the lower plate 41 so as to be positioned below the through holes 41*a*, 41*b*, 41*c* formed in the lower plate 41.

The inspection processing section 81 is configured with a so-called computer, and has an image analysis section 82 for analyzing image data transmitted from the cameras 63*a*, 73*a*, the cameras 63*b*, 72*b*, the cameras 63*c*, 72*c*, and the cameras 63*d*, 72*d*, and a judgment section 83 for judging the qualities of the upper and lower surfaces of the inspection objects K according to analysis results of the image analysis section 82, and outputting a control signal to the control valves 86*a*, 86*b*, 86*c*, 86*d* when judging that they are defective.

In this sorting device section 80, when the inspection processing section 81 receives image data, for example, from the cameras 63*a*, 72*a*, the received image data is analyzed by the image analysis section 82, and features related to the surface properties of the inspection object K such as stains and marks on the upper and lower surfaces, the outlines of the upper and lower surfaces, etc. are extracted.

Thereafter, the judgment section 83 judges the quality of the inspection object K with respect to the surface properties on the basis of the feature data extracted by the image analysis section 82, and a control signal is transmitted from the judgment section 83 to the control valve 86*a* only when the inspection object K is judged defective.

When the control valve 86*a* receives the control signal, the control valve 86*a* is opened and the flow passage of the pipe is opened. Thereby, compressed air is supplied from the compressed-air supply source (not shown) to the flow passage 43*a* via the joint 85*a* and the through hole 47*a*, and is discharged from the opening formed in the middle plate 43. Thereby, the inspection object K which is passing through the opening in the slide-down passage 50 is blown off in the discharge direction. The inspection object K blown off by the compressed air is collected in the defective-product collecting box 87 through the cut portion 42*a* of the middle plate 42 and the through hole 41*a* of the lower plate 41.

When the inspection object K is judged good by the judgment section 83, a control signal is not output to the control valve 86*a* and the inspection object K continues to slide down in the slide-down passage 50 and is collected in the good-product collecting box 89.

The timing when a control signal is output from the judgment section 83 to the control valve 86*a* is determined in consideration for a slide-down time which is the time required until the inspection object K reaches the opening of the flow passage 43*a* after it is detected by the sensor 79*a* and imaged by the cameras 63*a*, 72*a*, and the sliding time is obtained experientially.

Similarly, with reference to the inspection objects K sliding down in the slide-down passages 51, 52, 53, the images thereof captured by the cameras 63*b*, 72*b*, the cameras 63*c*, 72*c*, and the cameras 63*d*, 72*d* are transmitted to the image analysis section 82 and features related to the surface properties of the inspection objects K are extracted by the image analysis section 82, and then the qualities thereof are judged by the judgment section 83. The inspection objects K which are judged good are collected in the good-product collecting box 89. With reference to the inspection objects K which are judged defective, a control signal is transmitted from the judgment section 83 to the corresponding valves 86*b*, 86*c*, 86*d*, and the inspection objects K are blown off in the discharge direction by compressed air supplied into the flow passage 43*b*, 45*a*, 45*b* and are collected in the defective-product collecting box 87 through the cut portion 44*a* and the through hole 41*b*, the cut portion 44*b* and the through hole 41*b*, or the cut portion 46*a* and the through hole 41*c*.

According to the appearance inspection apparatus 1 of the embodiment having the above-described configuration, inspection objects K which are supplied into the hopper 11 are in turn supplied to the aligning and conveying device 25 by the vibration feeding device 10. At this time, they are fallen down on the second supply plate 16 through the trough holes 15*a* of the first supply plate 15, and thereby deposited particles are removed from the inspection objects K, and fragments of broken objects are also removed. Thereby, the inspection objects K having an almost normal shape are put in a clean condition to some extent and supplied to the aligning and conveying device 25.

The inspection objects K supplied to the aligning and conveying device 25 reach the conveyance end in a state of being aligned in four lines by passing through the primary aligning and conveying passages 33*a*, 33*b* and passing through the secondary aligning and conveying passages 35*a*, 35*b*, 35*c*, 35*d*, and enter the slide-down passages 50, 51, 52, 53 of the slide-down mechanism 40 and freely slide downward in the slide-down passages 50, 51, 52, 53. At this time, the inspection objects K slide down while their speed is gradually increased by the gravitational acceleration, and slides down in a state of being sufficiently separated from each other while intervals between the inspection objects K sliding down are gradually increased.

When the inspection objects K sliding down in the slide-down passages 50, 51, 52, 53 are detected by the sensors 79*a*, 79*b*, 79*c*, 79*d*, respectively, the upper and lower surfaces thereof are imaged by the corresponding cameras 63*a*, 72*a*, cameras 63*b*, 72*b*, cameras 63*c*, 72*c*, and cameras 63*d*, 72*d*, and the images are transmitted to the inspection processing section 81 of the sorting device section 80.

In the inspection processing section 81, the received image data are analyzed by the image analysis section 82, and the quality of each inspection object K is judged with respect to the surface properties by the judgment section 83 on the basis of the analysis results.

The inspection objects K which are judged good by the judgment section 83 continue to slide down in the slide-down passages 50, 51, 52, 53 and are collected in the good-product collecting box 89. In the case of the inspection objects K which are judged defective by the judgment section 83, at the timing when the inspection objects K which are judged defective reach the openings of the corresponding flow passages 43*a*, 43*b*, 45*a*, 45*b*, a control signal is transmitted from the judgment section 83 to the corresponding valves 86*a*, 86*b*, 86*c*, 86*d*, and the inspection objects K which are judged defective are blown off the slide-down passages 50, 51, 52, 53 by compressed air discharged from the openings and are collected in the defective-product collecting box 87.

In this way, the upper and lower surfaces of the inspection objects K which are in turn supplied to the slide-down mechanism 40 are inspected and the inspection objects K are sorted into good products and defective products.

Thus, in the appearance inspection apparatus 1 of the embodiment, since the slide-down mechanism 40 which has the slide-down passages 50, 51, 52, 53 tilted downward with respect to the extensions of the secondary aligning and conveying passages 35*a*, 35*b*, 35*c*, 35*d* of the aligning and conveying device 25 conveying the inspection objects K by vibration is employed in order to image the inspection objects K in a state where they are separated one by one, the structure thereof is extremely simple and very compact. Therefore, the manufacturing cost thereof is extremely low compared with a conventional appearance inspection apparatus having a belt, a power for driving the belt, a vacuum pump etc., and the installation area for the apparatus can be small, and therefore, it is possible to reduce the cost required for inspection.

Further, since it is possible to image the upper and lower surfaces of the inspection object K simultaneously and judge the qualities thereof, it is possible to perform an efficient inspection. Furthermore, since the upper and lower surfaces of the inspection object K are illuminated from the front and back sides thereof in the slide-down direction when imaging, it is possible to illuminate the entire upper and lower surfaces of the inspection object K, and therefore, it is possible to perform an accurate inspection.

Further, in the embodiment, since the inspection objects K are aligned in four lines and inspected, the throughput per hour time is high, and in this sense also, it is possible to perform an efficient inspection.

Furthermore, because the slide-down speed of the inspection object K differs depending on the material etc. of the inspection object K, when sliding down at a too high speed, the inspection objects K cannot be accurately imaged, and, in contrast, when sliding down at a too low speed, the inspection objects K cannot be separated at sufficient intervals. In both cases, accurate inspection cannot be performed. However, since it is possible to adjust the tilt angle by means of the angle adjustment part in order to obtain an optimum slide-down speed depending on the inspection object K, it is possible to perform more accurate inspection. When the tilt angle of the slide-down passages 50, 51, 52, 53 with respect to a horizontal plane is adjusted so as to be within a range of 20° to 30°, it is possible to obtain an optimum speed with reference to the inspection object K of most materials.

Thus, one embodiment of the present invention has been described. However, specific modes in which the present invention can be realized are not limited thereto, and other modes can be employed as long as they do not depart from the intention of the present invention.

| Reference Signs List | |
|---|---|
| 1 | Appearance inspection apparatus |
| 10 | Vibration feeding device |
| 11 | Hopper |
| 13 | Conveying portion |
| 15 | First supply plate |
| 16 | Second supply plate |
| 20 | Vibration exciter (for supply) |
| 25 | Aligning and conveying device |
| 26 | Aligning and conveying member |
| 35a, 35b, 35c, 35d | Secondary aligning and conveying passage |
| 37 | Vibration exciter (for alignment) |
| 40 | Slide-down mechanism |
| 50, 51, 52, 53 | Slide-down passage |
| 60 | Imaging device section |
| 61 | Upper imaging device |
| 64 | Front illuminating unit |
| 67 | Rear illuminating unit |
| 70 | Lower imaging device |
| 73 | Front illuminating unit |
| 76 | Rear illuminating unit |

CITATION LIST

Patent Literature

Patent Document 1: Japanese Unexamined Patent Application Publication No. 61-211209

What is claimed is:

1. An appearance inspection apparatus comprising:

an aligning and conveying device having an aligning and conveying member with one or a plurality of conveying passages, and a vibration exciter for alignment for applying a vibration to the aligning and conveying member, the aligning and conveying device for advancing inspection objects placed on the aligning and conveying member in the conveying passages by applying a vibration to them, and for, in each of the conveying passages, aligning the inspection objects in a row and conveying them;

a slide-down mechanism having slide-down passages which are separately connected to the respective conveying passages of the aligning and conveying member for allowing the inspection object to freely slide down therein, and which are provided being tilted downward with respect to extensions of the conveying passages;

an imaging device disposed in the vicinity of the slide-down passages for imaging upper surfaces of the inspection objects sliding down in the slide-down passages; and a sorting device for analyzing the images of the inspection objects which are captured by the imaging device, judging the qualities of the upper surfaces of the inspection objects, and sorting the inspection objects sliding down in the slide-down passages on the basis of the judgment results, wherein the slide-down mechanism has an angle adjustment part for adjusting a tilt angle of the slide-down passages.

2. The appearance inspection apparatus set forth in claim 1, wherein the imaging device is attached to the slide-down mechanism.

3. The inspection apparatus set forth in claim 1, wherein the tilt angle of the slide-down passages with respect to a horizontal plane is set within a range of 20° to 30°.

4. The appearance inspection apparatus set forth in claim 1, wherein the imaging device has an illumination mechanism for illuminating the upper surfaces of the inspection objects sliding down in the slide-down passages from the front and back sides in the slide-down direction thereof.

5. An appearance inspection apparatus comprising:

an aligning and conveying device having an aligning and conveying member with one or a plurality of conveying passages, and a vibration exciter for alignment for applying a vibration to the aligning and conveying member, the aligning and conveying device for advancing inspection objects placed on the aligning and conveying member in the conveying passages by applying a vibration to them, and for, in each of the conveying passages, aligning the inspection objects in a row and conveying them;

a slide-down mechanism having slide-down passages which are separately connected to the respective conveying passages of the aligning and conveying member for allowing the inspection object to freely slide down therein, and which are provided being tilted downward with respect to extensions of the conveying passages;

an imaging device disposed in the vicinity of the slide-down passages for imaging upper surfaces of the inspection objects sliding down in the slide-down passages; and a sorting device for analyzing the images of the inspection objects which are captured by the imaging device, judging the qualities of the upper surfaces of the inspection objects, and sorting the inspection objects sliding down in the slide-down passages on the basis of the judgment results; and a vibration feeding device disposed on the upstream side in the conveying direction of the aligning and conveying device, wherein the vibration feeding device is configured with:

a hopper for receiving a large number of inspection objects;

a first supply plate, one end of which is positioned below the hopper, the other end of which is extended on the aligning-and-conveying-member side, and in which a large number of through holes are bored, the through holes each having such a size that the inspection objects can pass therethrough;

a second supply plate which is disposed below the first supply plate, one end of which is positioned below the part of the first supply plate where the through holes are bored, and the other end of which is connected to the aligning and conveying member; and a vibration exciter for supply for applying a vibration to the fist supply plate and the second supply plate.

6. The appearance inspection apparatus set forth in claim 5, wherein in the second supply plate, a large number of through holes each having such a size that the inspection objects cannot pass therethrough are bored.

7. An appearance inspection apparatus comprising:

an aligning and conveying device having an aligning and conveying member with one or a plurality of conveying passages, and a vibration exciter for alignment for applying a vibration to the aligning and conveying member, the aligning and conveying device for advancing inspection objects placed on the aligning and conveying member in the conveying passages by applying a vibration to them, and for, in each of the conveying passages, aligning the inspection objects in a row and conveying them;

a slide-down mechanism having slide-down passages which are separately connected to the respective conveying passages of the aligning and conveying member for allowing the inspection object to freely slide down therein, and which are provided being tilted downward with respect to extensions of the conveying passages;

an imaging device disposed in the vicinity of the slide-down passages for imaging upper surfaces of the inspection objects sliding down in the slide-down passages; and a sorting device for analyzing the images of the inspection objects which are captured by the imaging device, judging the qualities of the upper surfaces of the inspection objects, and sorting the inspection objects sliding down in the slide-down passages on the basis of the judgment results, wherein the slide-down passages each has a bottom surface at least a part of which is configured with a transparent member;

the imaging device is configured to image the upper surfaces of the inspection objects sliding down in the slide-down passages, and to image the lower surfaces of the inspection objects through the transparent members; and the sorting device is configured to analyze both of the images of the upper and lower surfaces of the inspection objects, which are captured by the imaging device, judge the qualities of the upper and lower surfaces of each inspection object, and sort the inspection objects on the basis of the judgment results.

8. The appearance inspection apparatus set forth in claim 7, wherein the slide-down mechanism has an angle adjustment part for adjusting a tilt angle of the slide-down passages.

9. The appearance inspection apparatus set forth in claim 8, wherein the imaging device is attached to the slide-down mechanism.

10. The inspection apparatus set forth in claim 7, wherein the tilt angle of the slide-down passages with respect to a horizontal plane is set within a range of 20° to 30°.

11. The appearance inspection apparatus set forth in claim 7, wherein the imaging device has a first illumination mechanism for illuminating the upper surfaces of the inspection objects sliding down in the slide-down passages from the front and back sides in the slide-down direction thereof, and a second illumination mechanism for illuminating the lower surfaces of the inspection objects from the front and back sides in the slide-down direction through the transparent members.

12. The appearance inspection apparatus set forth in claim 7, wherein the appearance inspection apparatus further comprises a vibration feeding device disposed on the upstream side in the conveying direction of the aligning and conveying device, and the vibration feeding device is configured with:

a hopper for receiving a large number of inspection objects;

a first supply plate, one end of which is positioned below the hopper, the other end of which is extended on the aligning-and-conveying-member side, and in which a large number of through holes are bored, the through holes each having such a size that the inspection objects can pass therethrough;

a second supply plate which is disposed below the first supply plate, one end of which is positioned below the part of the first supply plate where the through holes are bored, and the other end of which is connected to the aligning and conveying member; and a vibration exciter for supply for applying a vibration to the fist supply plate and the second supply plate.

13. The appearance inspection apparatus set forth in claim 12, wherein in the second supply plate, a large number of through holes each having such a size that the inspection objects cannot pass therethrough are bored.

* * * * *